US006699035B2

(12) United States Patent
Brooker

(10) Patent No.: US 6,699,035 B2
(45) Date of Patent: Mar. 2, 2004

(54) DETONATION FLAME ARRESTOR INCLUDING A SPIRAL WOUND WEDGE WIRE SCREEN FOR GASES HAVING A LOW MESG

(75) Inventor: Dwight Brooker, Shiatook, OK (US)

(73) Assignee: Enardo, Inc., Tulsa, OK (US)

( * ) Notice: Subject to any disclaimer, the term of this patent is extended or adjusted under 35 U.S.C. 154(b) by 53 days.

(21) Appl. No.: 09/947,861

(22) Filed: Sep. 6, 2001

(65) Prior Publication Data

US 2003/0044740 A1 Mar. 6, 2003

(51) Int. Cl.[7] ..... F23D 14/82

(52) U.S. Cl. ..... 431/346; 48/192; 222/189.01; 220/88.2

(58) Field of Search ..... 431/346; 48/192; 222/189.01; 220/88.2

(56) References Cited

U.S. PATENT DOCUMENTS

| | | | | |
|---|---|---|---|---|
| 802,380 A | | 10/1905 | Emerson et al. | |
| 1,681,698 A | | 8/1928 | Brooks | |
| 1,701,805 A | | 2/1929 | Dunn et al. | |
| 1,783,701 A | | 12/1930 | Cooke et al. | |
| 1,839,655 A | | 1/1932 | Dobbins | |
| 2,186,752 A | | 1/1940 | Connell | |
| 2,277,294 A | | 3/1942 | Brooks | |
| 2,333,567 A | | 11/1943 | Helmore | |
| 2,420,599 A | | 5/1947 | Jurs | |
| 2,758,018 A | * | 8/1956 | Lisciani | 48/192 |
| 4,093,818 A | | 6/1978 | Thwaites et al. | |
| 4,909,730 A | | 3/1990 | Roussakis et al. | |
| 5,145,360 A | * | 9/1992 | Rajewski | 431/346 |
| 5,211,554 A | * | 5/1993 | Rajewski | 431/346 |
| 5,336,083 A | | 8/1994 | Fajewski | |
| 5,415,233 A | | 5/1995 | Roussakis et al. | |
| 6,295,952 B1 | * | 10/2001 | Reynolds et al. | 122/14.31 |
| 6,338,319 B1 | * | 1/2002 | Vago | 122/13.01 |

FOREIGN PATENT DOCUMENTS

| | | |
|---|---|---|
| DE | 1123635 | 2/1962 |
| DE | 2 225 552 | 11/1973 |
| FR | 1 136 632 | 5/1957 |
| FR | 2 446 118 A1 | 8/1980 |
| GB | 344806 A | 3/1931 |
| GB | 1 047 091 | 11/1966 |
| GB | 1 500 913 | 2/1978 |
| SU | 1260007 A1 | 9/1986 |

* cited by examiner

*Primary Examiner*—Alfred Basichas
(74) *Attorney, Agent, or Firm*—Fellers, Snider, Blankenship, Bailey & Tippens, P.C.

(57) ABSTRACT

A detonation flame arrestor including an outer cylinder, an inner cylinder, and fill media. The outer cylinder and inner cylinder are secured to a canister flange on one end and include a domed face (cap) on the other end. On assembly, the inner cylinder secured to the canister flange is positioned inside the outer cylinder secured to the canister flange, altogether forming a canister. The fill media is inserted in the canister between the inner cylinder and the outer cylinder. Both the outer cylinder and the inner cylinder include a tapered spiral wound wire screen which forms their respective cylindrical circumferences. Contaminates are constrained between adjacent windings of the tapered wire screen. The canister is positioned in an outer housing in the flow path of a gas pipeline in such a manner that a flame front traveling through the pipeline enters the outer housing, impinges upon the domed face of the outer cylinder, makes an abrupt turn to enter the canister, passes through the fill media where the flame is extinguished, and the gas flow makes a second abrupt turn to exit the canister and continue in the flow path of the pipeline. The fill media includes irregular shaped spheres which provide a large surface area which acts as a heat sink to extinguish the flame.

20 Claims, 7 Drawing Sheets

DETONATION FLAME ARRESTOR INCLUDING A SPIRAL WOUND WEDGE WIRE SCREEN FOR GASES HAVING A LOW MESG

BACKGROUND OF THE INVENTION

1. Field of the Invention

This invention relates generally to the field of flame arrestors in pipe line applications.

2. Background of the Invention

A detonation flame arrestor is designed to extinguish a flame front resulting from an explosion or detonation of the gas in the line. However, in addition to extinguishing the flame, the flame arrestor must be capable of dissipating (attenuate) the pressure front that precedes the flame front. The pressure front (shock wave) is associated with the propagation of the flame front through the unburnt gas toward the flame arrestor. The flame induced pressure front is always in the same direction as the impinging flame travel. The pressure rise can range from a small fraction to more than 100 times the initial absolute pressure in the system.

A flame arrestor apparatus usually comprises flame extinguishing plates, ribbon and/or some type of fill media which includes very small gaps of a small diameter, typically less than the MESG of gases, media with passages that permit gas flow but prevent flame transmission by extinguishing combustion. This results from the transfer of heat from the flame to the plates and/or fill media which effectively provides a substantial heat sink.

Two very common flame arrestor element designs are of a crimped ribbon type such as described in U.S. Pat. Nos. 4,909,730, 5,415,233 as well as parallel plate type as described in U.S. Pat. No. 5,336,083 and Canadian Patent No. 1,057,187. The above is referred to as straight path flame arrestors because the gas flow takes a straight path from the channel entrance to the exit.

Flame arrestors are often used in installations where large volumes of gas must be vented with minimal back pressure on the system. It is generally understood that even small deviations in channel dimensions can compromise flame arrestor performance.

A known conflict results from the fact that gas line pressure is frequently maintained at atmospheric pressure or higher. Pressure drop resulting from a flame arrestor or back pressure created as a result of gas passage through the flame arrestor are undesirable. However, pressure drop resulting from passage of the flame through the plates, ribbons, or fill media in the flame arrestor assists in effectively extinguishing the flame. As a result, a need, therefore, exists for a detonation flame arrestor design which includes a large pressure drop per unit volume but a small aggregate pressure drop over the entire apparatus.

The extinguishing process (flame arrestment) is based on the drastic temperature difference between the flame and fill media material. As such, this is a process that not only depends on the temperature gradient, but also on the hydraulic diameter of the passages and the thermal conduction properties of the gas and the fill media.

The level of turbulence significantly affects the rate of heat loss of the flame within the flame arrestor passages. Turbulence is desirable to facilitate the level of heat loss within the flame arrestor. However, straight path flame arrestors of the currently known designs are inefficient in maximizing the amount of turbulence for effective flame arrestment. This is partly because the path of the flame front is unaltered through the flame arrestor. In addition, known straight path flame arrestor designs are inefficient in dispensing the initial shock wave or reflective shock wave. A need exists for a flame arrestor design which alters the flow of the flame front as it passes through the flame arrestor.

In addition, the fill media commonly used for detonation flame arrestors commonly include ceramic beads. Although ceramic beads have useful thermal characteristics, they are relatively fragile and cannot be compacted without crushing to minimize the space between adjacent beads, thereby maximizing surface area of the fill media and varying the path of travel of the flame creating additional turbulence. The ceramic media could also be crushed by the shock wave thereby leaving gaps larger than the MESG of the gas which would compromise the performance (flame stopping capabilities) of the flame arrestor. A need, therefore, exists for a flame arrestor including a fill media which can be compacted to minimize air space and surface area, thereby maximizing the heat sink properties of the fill media as well as increase turbulent flow through the spaces between adjacent components of the fill media.

A detonation flame arrestor must also be capable of attenuating a reflective pressure front in addition to the initial pressure front (shock wave). Initial shock waves impacting flame arrestor elements have been known to cause significant structural damage (element breach) causing the flame arrestor element to fail.

Prior art devices have been known to fail due to the pressures encountered in connection with a reflection pressure front. Although the flame is extinguished within the flame arrestor, a high pressure wave front may exit the outlet side of the flame arrestor as a result of the pressure rise from the initial shock wave. This high pressure wave front continues to travel along the pipe line in the direction of flow. This high pressure wave front, however, will be reflected by any discontinuity located in the pipe line. Discontinuities are the result of bends, stubs, valves, reducers, and the like. As a wave front strikes such a discontinuity, a reflection front is created which travels back towards the flame arrestor. Reflections from many objects along a pipe line can cause transient pressure increases many times the initial pressure. When these reflections enter the outlet side of the flame arrestor, the pressure within the flame arrestor can become many times that for which it was designed. While these pressure increases are of extremely short duration and transient in nature, they nonetheless are known to cause failures in flame arrestors.

A need, therefore, also exists for a flame arrestor that includes the capability of attenuating an initial shock wave and a reflection pressure front.

Another important factor in flame arrestor design relates to cleanability. Presently known parallel plate, ribbon, and/or fill media designs are known to become blocked or clogged as a result of collection of contaminant particles carried in the gas stream. Once significant clogging occurs which restricts flow and increases pressure drop, the entire flame arrestor must be removed for cleaning or replacement. A need exists for a flame arrestor design which can be cleaned in stream and/or easily accessed for cleaning and/or replacement of the fill media.

Detonation flame arrestors known presently in industrial applications are not known to be effective for low Maximum Experimental Space Gap (MESG) gases, such as Group B gases. In particular, known detonation flame arrestors are not effective for hydrogen gas or enriched oxygen and hydrogen applications. Ribbon or parallel plate detonation flame arrestor constructions cannot be cost effectively produced to meet the requirements of low MESG applications. A need, therefore, exists for a detonation flame arrestor design which can be manufactured in a cost effective manner which is capable of operation in low MESG gas environments.

SUMMARY OF THE INVENTION

The detonation flame arrestor of the present invention includes, generally, an outer member or cylinder secured to a canister flange, an inner member or cylinder secured to the canister flange and a fill media retained between the outer and inner cylinders. Both the outer cylinder and inner cylinder, while being secured to the canister flange on one end, include a domed face on their other end. The outer cylinder, inner cylinder, and canister flange together form a canister. The canister is secured within an outer housing bolted to a bulkhead which is welded to the inside of the outer housing. The outer housing is then fitted in the pipeline flow path such that the flow of gas passes into the outer housing and through the canister.

Both the outer cylinder and the inner cylinder include a spiral wound wedge wire screen which form their respective cylindrical circumferences. The respective spiral wound wedge wire screens of both the outer cylinder and the inner cylinder include wound wire having a tapered surface and a blunt (flat) surface such that the direction of the taper on the outer cylinder circumference points in the direction of flow of gas in the pipeline while the tapered surface of the inner cylinder points in the direction of flow of the gas in the pipeline, (pointing against a reverse flow). The inner cylinder is of a smaller diameter than the outer cylinder such that when the canister is assembled, the inner cylinder fits inside the outer cylinder such that the fill media is retained between the flat surface of the spiral wound wedge wire screen of the outer cylinder and the flat surface of the spiral wound wedge wire screen of the inner cylinder.

The domed face of the outer cylinder includes a hole to receive a media displacing bolt. The hole may be drilled and tapped so that the media displacing bolt may be threaded into the hole to accommodate tightening or removal. If a permanent canister construction is desired, the media displacing bolt may be welded in the hole in the domed face of the outer cylinder. The media displacing bolt is tapered such that when threaded through (or inserted and welded) the domed face of the outer cylinder, the tapered portion of the media displacing bolt presses into the fill media thereby compacting the fill media so as to reduce the air space between adjacent elements of the fill media.

The canister is positioned within the outer housing such that a pressure front which passes through the pipeline and into the outer housing impinges upon the domed face of the outer cylinder and the bulkhead. The detonation wave front is attenuated by the domed face of the outer cylinder and the bulkhead. Likewise, after the flame front is extinguished by passage through the canister, a reflected pressure front will impinge the underside of the domed face of the inner cylinder and become attenuated.

After the flame front impacts the domed face of the outer cylinder, it must make an abrupt (ninety degree (90°)) turn in order to pass through the spiral wound wedge wire screen of the outer cylinder. The gap size between adjacent windings of the spiral wound wedge wire screen can be chosen for a particular gas or gas group and acts as the first mechanism for arresting the flame passing therethrough. The flame then passes through the fill media and is further quenched as a result of passing through the torturous path required to pass through the fill media and contacting the surface of the fill media (heat sink). Once the quenched gas exits the fill media, it passes through the spiral wound wedge wire screen of the inner cylinder which is likewise gapped for a chosen gas or gas group. Once the gas exits the inner cylinder, it must again make an abrupt (ninety degree (90°)) turn to continue flow through the pipeline.

Accordingly, flame arrestment is achieved in the detonation flame arrestor of the present invention through the combination of the gaps between adjacent windings of the spiral wound wedge wire screens on both the outer cylinder and inner cylinder as well as the irregular shaped fill media. The gap size between adjacent windings of the spiral wound wedge wire screen being lower than the MESG of the gas so as to provide the first mechanism for flame arrestment. The irregular shaped fill media provides a torturous flame path and large heat transfer area between the flame front and the fill media.

This transverse design of the flame arrestor of the present invention serves two very significant functions. First, it allows the shock wave to impact the high strength surfaces of the domed faces of the outer cylinder and the bulkhead as stated above. The second function is to allow the total surface area (dictated by the length) of the canister to be varied to accommodate a desired pressure drop simply by lengthening the canister as opposed to increasing the diameter as with a straight path design.

In the preferred embodiment, the fill media consists of irregular shaped spheres such as cut-wire shot. The irregular shaped spheres create irregular sized gaps between adjacent compacted spheres in the fill media. The irregular shape of the individual components of the fill media as well as the irregular shaped gaps formed between adjacent spheres disrupts the laminar flow of a flame wave (creates turbulence). Moreover, in addition to increasing turbulence, the fact that the spheres are of irregular shape means that they have greater surface area than precision spheres to create a heat sink so as to extinguish a flame passing therethrough. Accordingly, increased heat transfer is achieved. The canister, including the fill media contained therein, is designed to provide an optimum pressure drop per unite volume to provide maximum flame arrestment. Again, as a result of the transverse design, the aggregate pressure drop resulting from the passage of the gas through the canister can be maintained at a low value by varying the length of the canister as required.

The tapered surface of the wire forming the spiral wound wedge wire screen serves the dual purposes of providing aerodynamic gas flow characteristics into the canister and also to provide a tapered or angled surface such that debris is trapped between adjacent windings of the tapered surface of the spiral wound wedge wire screen. Aerodynamic gas flow is created by the point of the taper cutting through the gas flowing past. Allowing the gas to flow past improves the flow characteristics without causing a significant pressure drop. In addition, while a parallel plate design would contribute to laminar flow of the gas cutting through the plates, the tapered wedge wire, in contrast, contributes to increase turbulence by increasing velocity and decreasing pressure of the shock wave.

Debris trapped between adjacent windings of the tapered surface of the spiral wound wedge wire screen can be easily dislodged upon a reverse flow within the canister by injecting a high pressure cleaning solution through the domed face of the outer cylinder of the canister. This can be accomplished by installing high pressure nozzles in the domed face of the outer cylinder adjacent the media displacing bolt.

The size of the gaps between adjacent windings of the spiral wound wedge wire screen of both the outer cylinder and the inner cylinder acts to extinguish a flame passing therethrough according to known characteristics of selected gases. Thus, a gap size can be selected depending upon the type of gas to be carried by the application, and secondarily, the wound wedge wire screen also serves to contain the fill media.

The wedge wire screen on the inner and outer cylinders can be effectively produced by spiral winding a tapered wire around their respective cylindrical circumferences. The gap size can be controlled so as to be lower than the published (known) MESG properties of a particular gas or gas group winding the tapered wire around the cylinders can be done economically while maintaining strict tolerances. The design of the present invention is therefor, effective for low MESG gas applications, such hydrogen.

The fill media can be recharged or replaced by removing the canister from the external housing, removing the fill media by removing the tapered displacing bolt, and replacing the fill media with fresh fill media. The new fill media could be of a different size as required with a different size to accommodate a different gas, type, or group, as desired. Alternatively, the removed fill media can be cleaned and reinstalled for continued use.

It is therefore an object of the present invention to provide a detonation flame arrestor that includes a canister which requires the flame front to make an abrupt direction change to pass through the canister.

It is an additional object of the present invention to provide a detonation flame arrestor which includes a spiral wound wedge wire screen.

It is a further object of the present invention to create a detonation flame arrestor including a spiral wound wedge wire screen on an inner cylinder and an outer cylinder together forming the canister.

It is yet a further object of the present invention to provide a detonation flame arrestor including a spiral wound wedge wire screen using a wire which is tapered on at least one surface so as to trap debris and increase the flow and create turbulence characteristics through the wedge wire screen.

It is a still further object of the present invention to provide a detonation flame arrestor including a spiral wound wedge wire screen which also includes a gap between adjacent windings of the screen selected for a particular gas type or gas group.

It is yet an additional object of the present invention to include a fill media between the inner cylinder and outer cylinder to act as a torturous path and heat sink to extinguish a flame passing therethrough.

It is a yet another object of the present invention to include an irregular shaped fill media to increase surface area and also to increase the turbulence of the gas/flame passing therethrough.

It is an object of the present invention to provide a detonation flame arrestor design which is effective for low MESG gas applications.

It is also an object of the present invention to provide a detonation flame arrestor including an inner cylinder and outer cylinder with a fill media therebetween which is capable of being removed for cleaning/recharge or replaced with a fill media of a different, size/characteristic selected for a different gas type or gas group.

Additional objects of the present invention include attenuation of the pressure front and reflective pressure front by designing the flame arrestor to provide a structurally sound domed face on both the outer cylinder and inner cylinder.

Further objects, features, and advantages of the present invention will be apparent to those skilled in the art upon examining the accompanying drawings and upon reading the following description of the preferred embodiments.

DETAILED DESCRIPTION OF THE PREFERRED EMBODIMENT

Figure 1:
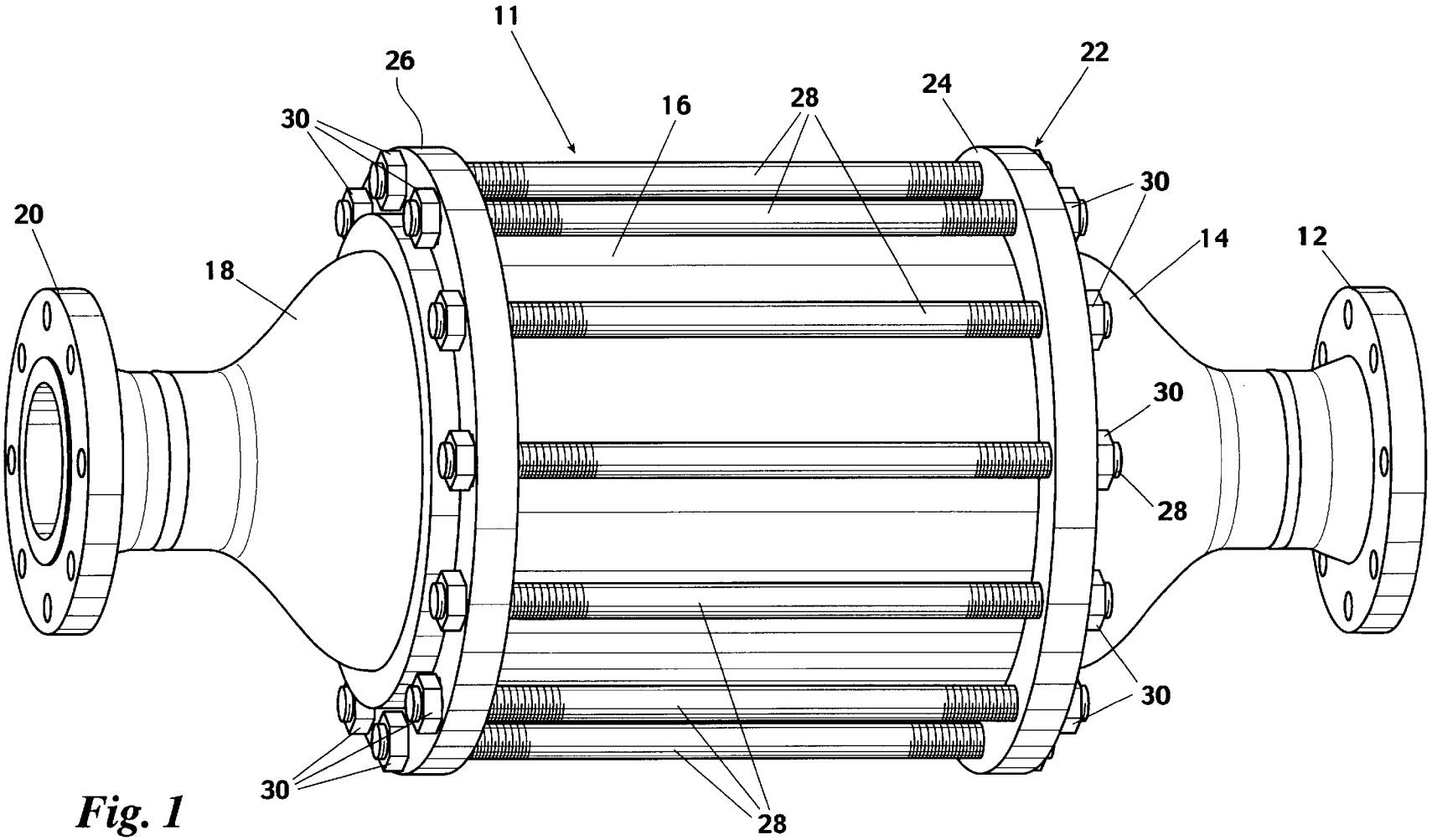
FIG. 1 is an isometric view of the external housing of the flame arrestor of the present invention as it would be installed in pipeline duty.

An external view of the detonation flame arrestor 10 of the present invention is shown in FIG. 1. Detonation flame arrestor 10 is designed to be placed in line in a gas pipeline (not shown) in which the gas line has an inflow end and an outflow end (not shown). FIG. 1 depicts the external housing of flame arrestor 10 which is of a design generally known in the art and includes an input flange 12 for connection to the inflow end of the gas line, an inlet housing 14, an external housing body 16, an outlet housing 18, and an outlet flange 20 for connection to the outflow end of the gas line. Inlet flange 12 and outlet flange 20 are raised face weld neck flanges known in the industry for flame arrestor service. The external housing of flame arrestor 10, therefore, provides a substantially hollow pressure vessel shell which is in open internal communication with the gas line.

The external housing 11 of flame arrestor 10, and particularly inlet housing 14, external housing body 16, and outlet housing body 18 are supported and retained together by a radial frame 22. Radial frame 22 is also of a construction known in the industry and includes a pair of ring flanges 24 and 26 such that ring flange 24 encircles inlet housing 14 and ring flange 26 encircles outlet housing 18.

Figure 2:
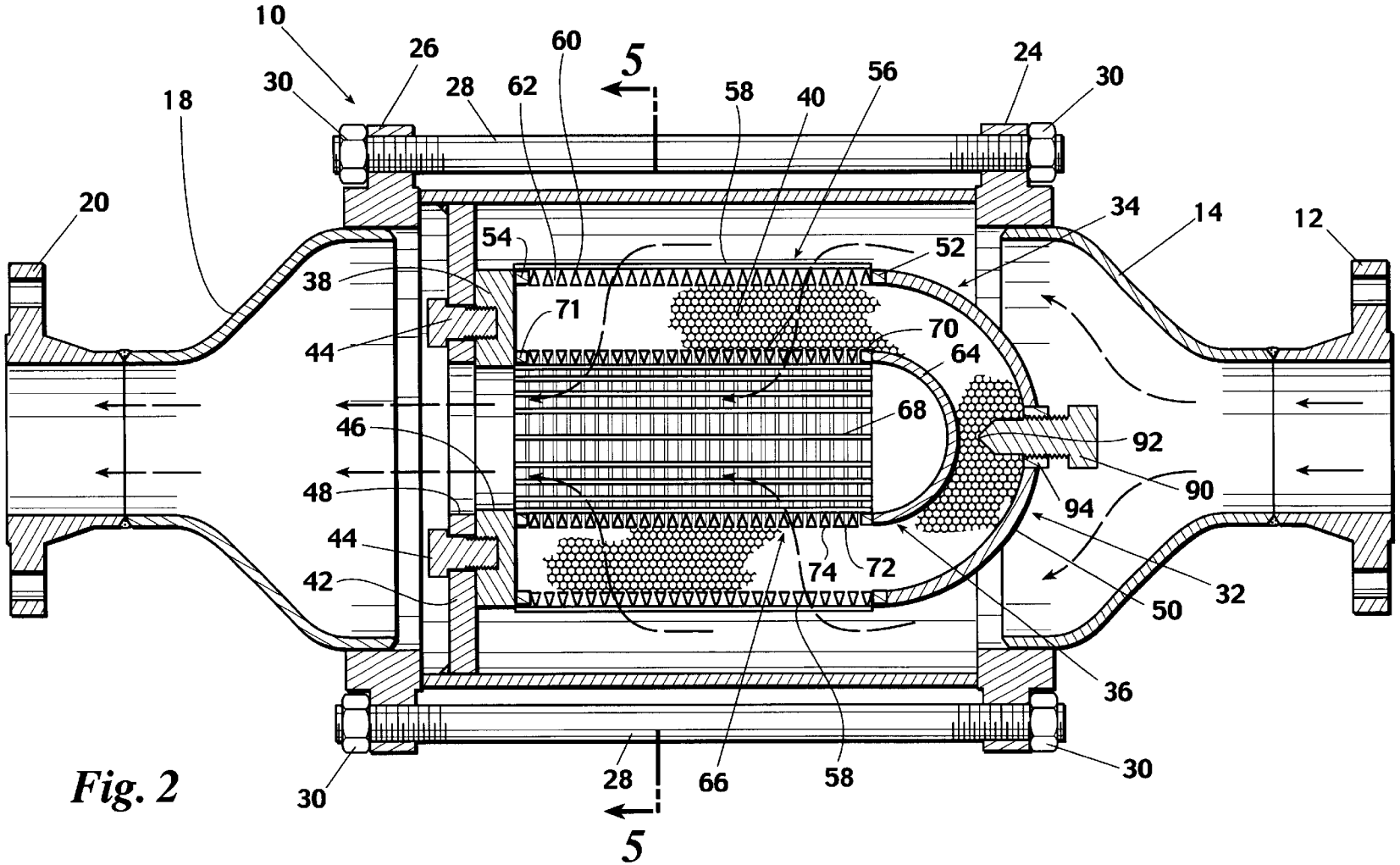
FIG. 2 is a side cut-away view of the detonation flame arrestor of the present invention including spiral wound wedge wire screens.
Figure 3:
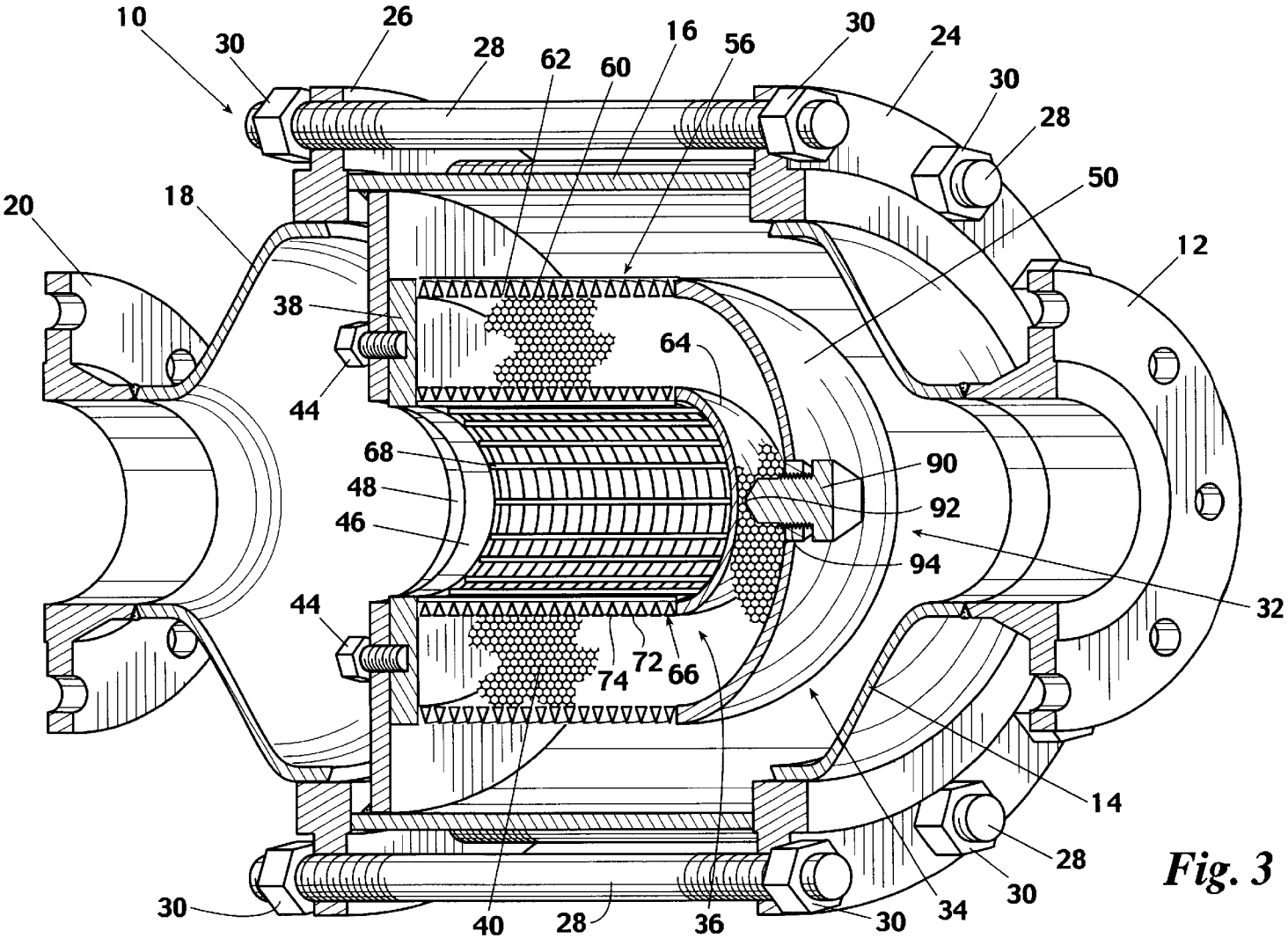
FIG. 3 is a side cut-away view of FIG. 2 rotated approximately thirty (30°) degrees.
Figure 4:
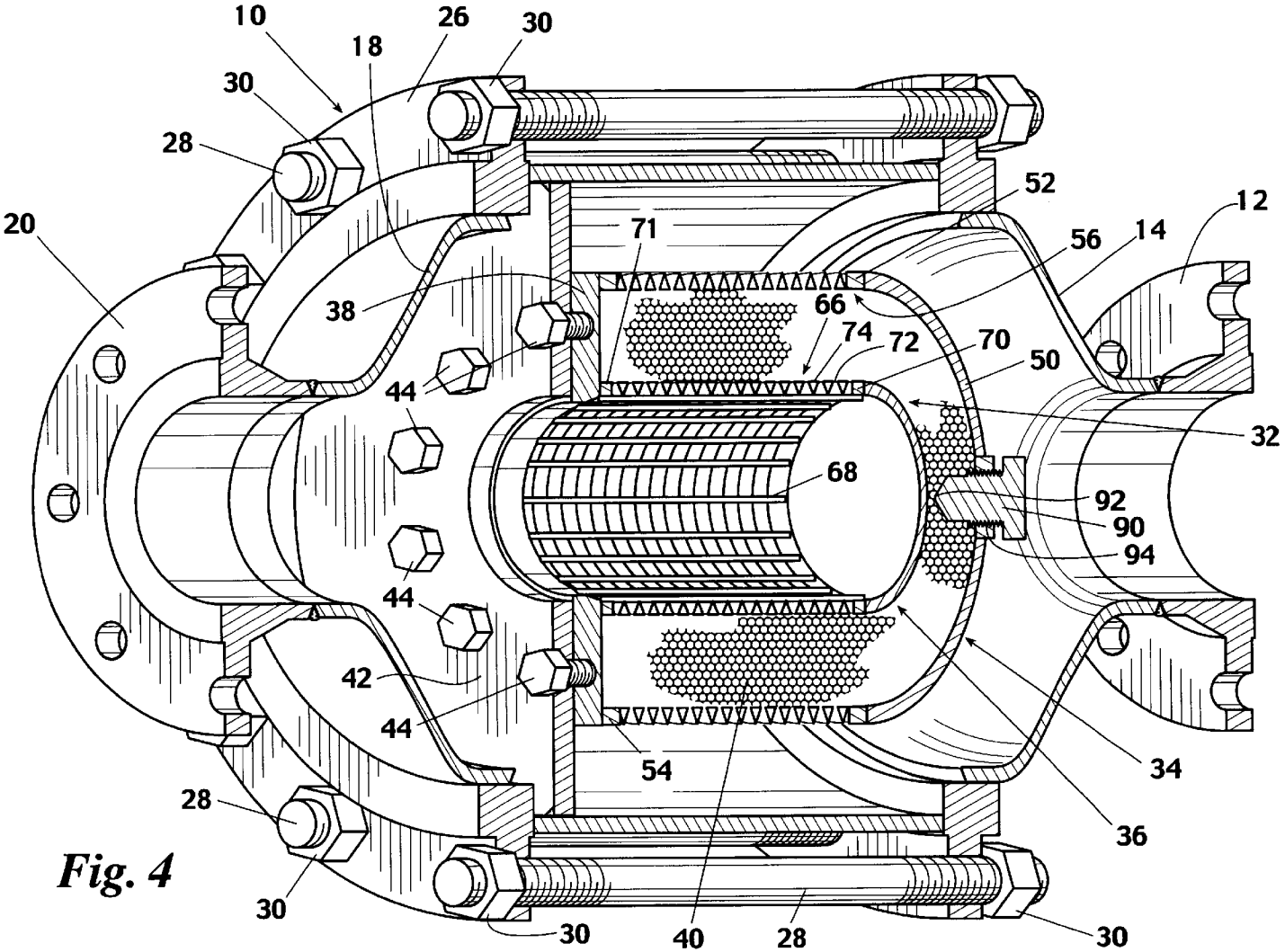
FIG. 4 is the side cut-away view of FIG. 2 rotated approximately thirty (30°) degrees in the opposite direction of FIG. 3.

As can be seen also in FIG. 2, ring flanges 24 and 26 bound and support external housing body 16 and secure inlet housing 14 and outlet housing 18 to external housing body 16. Ring flanges 24 and 26 are retained by a plurality of threaded bolts, collectively 28, positioned around the circumference of flame arrestor 10 along ring flanges 24 and 26. Ring flanges 24 and 26 are retained onto threaded bolts 28 by a plurality of nuts, collectively 30, threaded onto the terminal ends of threaded bolts 28 on the opposite divergent surfaces of ring flanges 24 and 26 in the manner depicted in FIGS. 1–4.

Referring next to FIG. 2 which is a side cut-away view of flame arrestor 10 depicting a canister 32 mounted within the external housing of flame arrestor 10. As depicted in FIG. 2, canister 32 is mounted within the external housing such that its longitudinal axis is parallel to, and concentric with, the longitudinal axis of exterior housing 11 (FIG. 1). This means that the flow pattern through flame arrestor 10 through canister 32 is transverse to the longitudinal axis of external housing 11, and the longitudinal axis of the pipeline. The transverse orientation of canister 32 within the external housing means that gas flow into inlet housing 14 through inlet flange 12 from the inflow of the gas line passes around canister 32 and is required to take an abrupt turn, 90° in the preferred embodiment, to pass through canister 32 and takes a second abrupt turn to exit from canister 32 into and through outlet housing 18, outlet flange 20 on into the outflow end of the pipeline. The direction of flow of gas in FIG. 2 is illustrated by arrows entering the external housing through inlet flange 12, passing through inlet housing 14 around canister 32 between canister 32 and the inside of external housing body 16, turning abruptly into and through to the center of canister 32, and turning again abruptly out of canister 32 into outlet housing 18 and then exiting through outlet flange 20.

Canister 32 includes an outer member or cylinder 34, an inner member or cylinder 36, a canister flange 38, and fill media 49 retained between inner cylinder 36 and outer cylinder 34. Both outer cylinder 34 and inner cylinder 36 are welded to canister flange 38. A ring-shaped bulkhead 42 is fixed within external housing body 16. In the preferred embodiment, bulkhead 42 is the same diameter as, and is permanently welded within, external housing body 16.

By way of example, a canister of the following dimensions has been found suitable to arrest a detonation flame in a hydrogen gas environment in a four inch (4") pipeline application. In the preferred embodiment, outer cylinder 34 and inner cylinder 36 are constructed of T-304 stainless steel in order to resist corrosion, however, it is understood that other metals and alloys are suitable, depending upon the gas environment.

Outer cylinder:

8" ID×15" overall length having a 10" length of spiral wound wedge wire screen;

4" long×8" domed face;

½" long first weld ring;

½" long second weld ring;

Inner cylinder:

4¼" OD×13¼" overall-length having a 10" length of spiral wound wedge wire screen;

2½" long×4" domed face;

⅜" long first weld ring;

⅜" long second weld ring;

½" thick canister flange, approximately 8½" diameter.

Bulkhead 42 serves several important functions including attenuation of pressure (shock) waves (discussed below), creates a barrier within external housing body 16 to prevent a flame front from bypassing canister 32, and forms the structure which retains canister 32 in its transverse orientation within the external housing. With reference to FIG. 2 taken in combination with FIG. 4, a plurality of holes are drilled around the annular circumference of ring-shaped bulkhead 42 in order to receive a plurality of bolts, collectively 44, which thread into canister flange 38. Bolts 44, threaded into canister flange 38, retain canister 32 in its transverse orientation within the external housing of flame arrestor 10.

Canister flange 38 is likewise ring-shaped, however, canister flange 38 has a smaller diameter than bulkhead 42 in its preferred embodiment. Canister flange 38 is drilled and tapped with holes around its bottom annular surface such that the holes match the holes drilled through bulkhead 42. The holes drilled in canister flange 38 are tapped with threads which mate the threads of bolts 44. Moreover, the holes drilled and tapped in canister flange 38 do not extend entirely through canister flange 38 in the preferred embodiment in order to prevent gas, or more significantly a flame front, from escaping into outlet housing 18 around bolts 44. The width of ring-shaped canister flange 38, in the preferred embodiment, is approximately equal to the space formed between outer housing 34 and inner housing 36 which retains fill media 40, plus the width of outer housing 34 and inner housing 36 which are welded onto canister flange 38.

Both canister flange 38 and bulkhead 42 are ring-shaped and include concentric holes 46 and 48 machined through the center of canister flange 38 and bulkhead 42, respectively. The size of concentric holes 46 and 48 is approximately the same size as the internal diameter of inner cylinder 36. The purpose of concentric holes 46 and 48 is to allow the unrestricted passage of gas exiting canister 32 through the inside of inner cylinder 36 to pass out of the inside of inner cylinder 36 and into outlet housing 18 which will exit flame arrestor 10 through outlet flange 20 and into the outbound pipeline (as illustrated by the arrows in FIG. 2).

Figure 5:
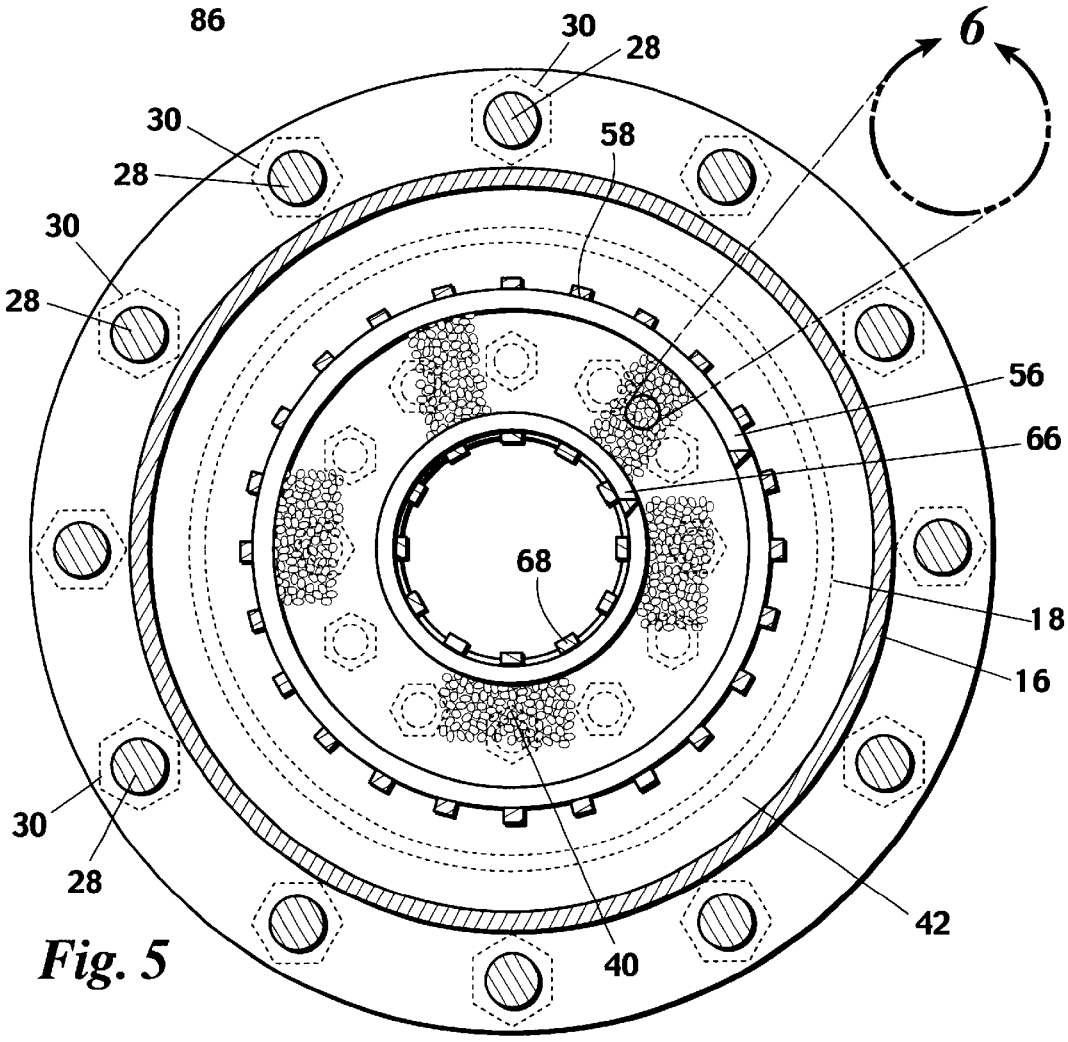
FIG. 5 is a view taken along line 5—5 of FIG. 2.
Figure 7:
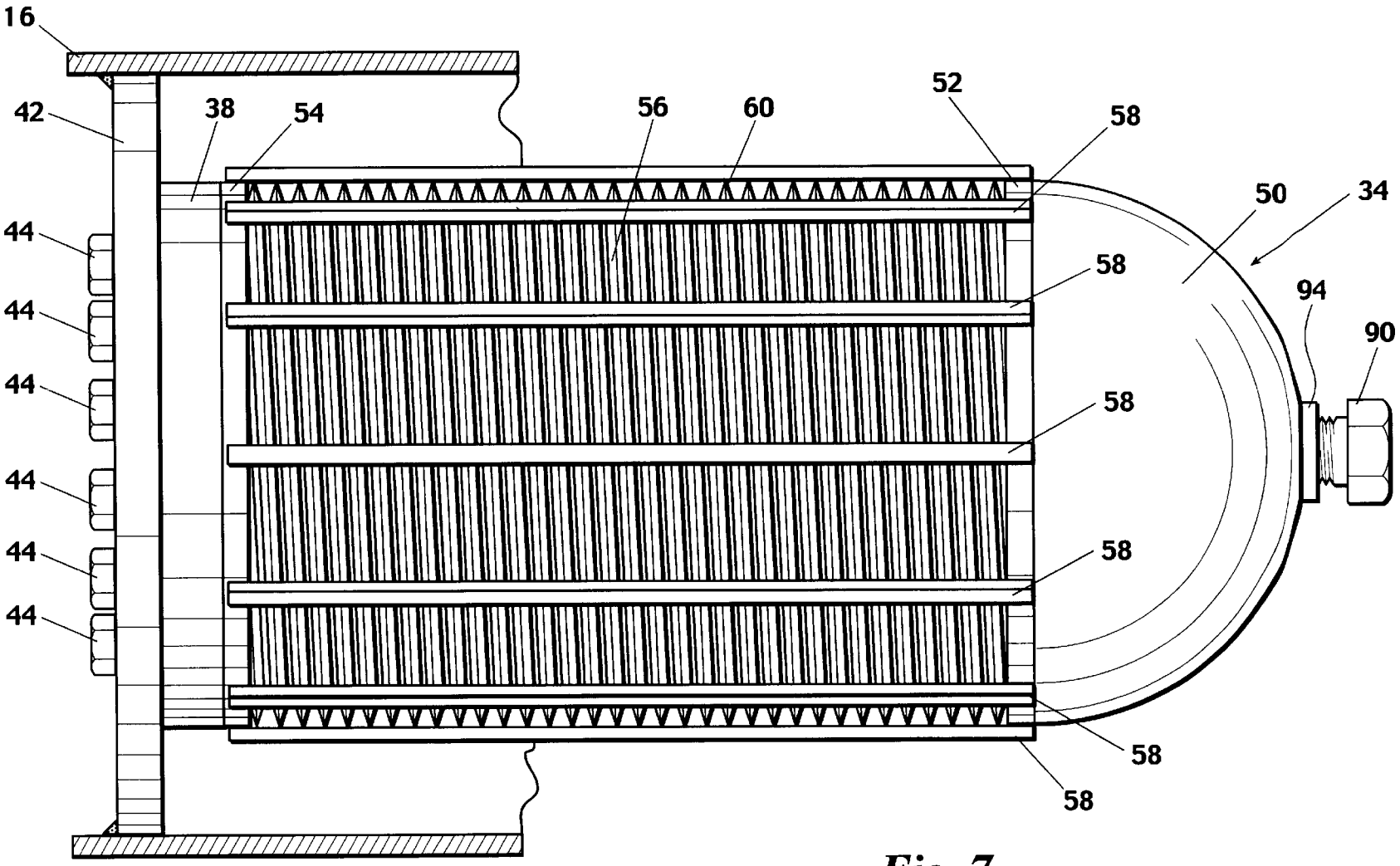
FIG. 7 is a side view of the outer cylinder of the flame arrestor of the present invention showing its spiral windings.

With specific reference to FIGS. 2, 5 and 7, the construction of outer cylinder 34 shall next be described. Outer cylinder 34 includes, generally, a domed face 50, a first weld ring 52, a second weld ring 54, a spiral wound wedge wire screen 56 which is coiled between first weld ring 52 and second weld ring 54, and a plurality of support ribs, collectively 56 which bound the outer circumference of outer cylinder 34.

Weld ring 52 is welded to domed face 50 while weld ring 54 is welded to canister flange 38. Wire screen 56 is a spiral wound wire with a tapered (wedge) shape surface and a flat (blunt) surface. Spiral wound wedge wire 56 is a continuous spiral winding from first weld ring 52 to second weld ring 54. The tapered (wedge) surface 60 is spot welded in the preferred embodiment to support ribs 58 to form the outer circumference of outer cylinder 34. The ends of support ribs 58 are welded to first weld ring 52 and second weld ring 54 respectively. Accordingly, a unitary, substantially cylindrical outer cylinder 34 is described.

Likewise, inner cylinder 36 includes a domed face 64, a spiral wound wedge wire screen 66, and support ribs, collectively 68. Ribs 68 are identified in FIG. 8 collectively and representative rib 68 is identified FIGS. 2–5. Inner cylinder 36 also includes a first weld ring 70 (which can be seen in greater detail in FIG. 8) which is welded to domed face 36 and a second weld ring 71 which is welded to canister flange 38. The ends of support ribs 68 are welded to the weld rings. Spiral wound wedge wire 66 is a continuous spiral winding between the two weld rings. The tapered surface 72 is spot welded to support ribs 68 to form the inner circumference of inner cylinder 36.

Spiral wound wedge wire screen 66 of inner cylinder 36 includes a tapered surface 72 and a blunt surface 74. As can be seen in FIGS. 2–4 and 8, the tapered surface 72 of spiral wound wedge wire screen 66 of inner cylinder 64 is oriented in the opposite manner such that tapered surface 72 of spiral wound wedge wire screen 66 of inner cylinder 36 points toward the center of inner cylinder 36 while the tapered surface 60 of spiral wound wedge wire screen 56 of outer cylinder 34 points away from the inside of outer cylinder 34. Accordingly, fill media 40 is retained within canister 32 between blunt surface 62 of spiral wound wedge wire screen 56 of outer cylinder 34 and blunt surface 74 of spiral wound wedge wire screen 66 of inner cylinder 36. The spiral wound wedge wire screen 56 and 66 of outer cylinder 34 and inner cylinder 36, respectively, in the preferred embodiment is VeeWire® screen commercially available from USF Johnson Screens.

Canister 32 is secured to bulkhead 42 in the transverse orientation described above in order that a pressure wave front (shock wave) which passes through the pipeline as a result of a detonation of the gas contained in the pipeline will enter flame arrestor 10 through inlet flange 12 and inlet housing 14. The shock wave will then impinge domed face 50 of outer cylinder 34 and will also pass into the space defined between external housing body 16 and outer cylinder 34 and impact bulkhead 42. Both bulkhead 42 and domed face 50 of outer cylinder 34 are constructed to withstand the force of an impinging shock wave. The detonation wave front (shock wave) is thereby attenuated by the combination of domed face 50 of the outer cylinder 34 and bulkhead 42.

Likewise, a pressure front which may pass through flame arrestor 10 even though the flame front is extinguished, that may be reflected back into flame arrestor 10 through outer flange 20, outer housing 18 and back into canister 34 will be attenuated by the structural integrity of the bottom surface of bulkhead 42 and the inside surface of domed face 64 of inner cylinder 36 without causing damage to canister 32 or the external housing of flame arrestor 10. The transverse orientation of canister 32 within the outer housing of flame arrestor 10 allows the structural integrity of canister 32 to absorb a pressure front (shock wave) or reflected pressure front.

The tapered geometry of the wire forming the spiral wound wedge wire screen of both the outer cylinder 34 and inner cylinder 36 serves the dual purposes of providing aerodynamic gas flow characteristics into canister 32 and also traps debris and contaminants between adjacent windings of the tapered surfaces 60 and 72 of outer cylinder 34 and inner cylinder 36, respectively. Debris and contaminants trapped between respective adjacent tapered surfaces 60 and 72 can be easily removed in order to restore flow (reduce pressure drop) through canister 32 in a manner described below.

Aerodynamic gas flow into canister 32 past spiral wound wedge wire screen 56 of outer cylinder 34 occurs as result of tapered surface 60 of spiral wound wedge wire screen 56 cutting through the gas as it flows into canister 32 while causing minimal pressure drop. This is because tapered surface 60 of spiral wound wedge wire screen 56 causes an increase in the turbulence of the gas passing thereby as a result of increasing the velocity of the shock wave (pressure front) and decreasing the pressure. Additionally, the length of the spiral wound wedge wire screen 56 of canister 32 can be varied to accommodate a larger volume of gas to minimize pressure drop.

The size of the gaps between adjacent windings of the respective blunt surfaces 62 and 74 of spiral wound wedge wire screen 56 and 66 on outer cylinder 34 and inner cylinder 36 act to extinguish a flame passing therethrough according to the known MESG characteristics of a selected gas application. Accordingly, a gap size can be selected depending upon the type of gas to be carried by a certain gas line application. For the purposes of exemplification, the known MESG for hydrogen is 0.28 mm. In the example hydrogen gas application, the gap size between adjacent windings on the blunt surfaces 62 and 74 of spiral wound wedge wire screens 56 and 66 respectively would be sized so as to gain a significant increase in the velocity and a decrease in pressure of the pressure front. In a hydrogen application, a gap size of 0.025 inches has been found to be acceptable. Accordingly, the gap dimension measured between adjacent blunt surfaces 62 and 74 of adjacent windings of spiral wound wedge wire screen 56 and 66 respectively serve the significant function of extinguishing a flame front.

The significance of the spiral wound design of spiral wound wedge wire screen 56 of outer cylinder 34 and spiral wound wedge wire screen 66 of inner cylinder 36 is to provide a cost effective means of manufacture of a flame arrestor canister such that the gap size between adjacent blunt surfaces 62 and 74 of screen 66 can be consistently and accurately maintained that can be manufactured on a cost efficient basis.

In addition to the flame extinguishing capabilities of the gaps formed between the blunt surfaces 62 and 74 between adjacent windings of spiral wound wedge wire screen 56 and 66 of outer cylinder 34 and inner cylinder 36, respectively, blunt surfaces 62 and 74 serve the purpose of containing fill media 40 within canister 32. Fill media 40 in the preferred embodiment consists of cut-wire shot which is available commercially and used extensively as sand blasting grit in industrial sand blasting applications. Cut-wire steel shot is particularly suitable for the canister of the present invention due to the fact that the individual shot elements include irregular outer surfaces. The size of the particular shot selected will depend upon the gas application and is again dictated by the known MESG of the gas. By way of example, in the environment of a low MESG gas such as hydrogen (0.28 mm), the diameter of the steel shot suitable for the fill media must have a diameter such that the gap between the packed balls is close to the MESG of the gas. It has been found that in the preferred embodiment, cut-wire steel shot having a diameter of 0.039 inches is particularly suitable. Although the diameter of the individual component shot of the fill media is larger than the MESG of the gas, it is most important that the air space formed between the adjacent contacting component shot be less than the MESG of the gas. Accordingly, it is significant that the gap space between adjacent component shot in fill media 40 be less than 0.027 inches in a hydrogen gas environment in order for canister 32 to effectively extinguish a hydrogen gas flame front.

Figure 6:
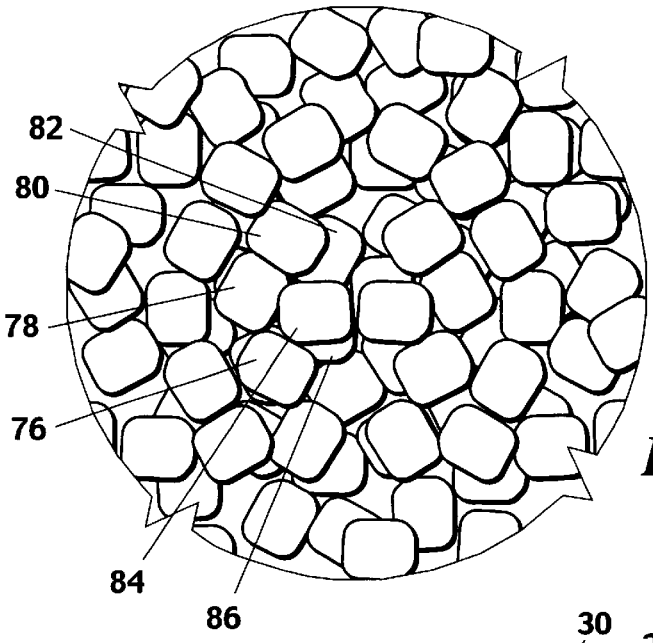
FIG. 6 is an enlarged view of detail 6 of FIG. 5 depicting the spacial arrangement of irregular shaped fill media of the preferred embodiment.

With reference to FIG. 2 taken in combination with FIGS. 5 and 6, the entire space formed between inner cylinder 36 and outer cylinder 34 is filled with fill media 40 and retained between blunt surface 62 of spiral wound wedge wire screen 56 of outer cylinder 34 and blunt surface 74 of spiral wound wedge wire screen 66 of inner cylinder 36. With particular reference to FIG. 6, the irregular shape of the individual components, for example 76, 78, 80, 82, 84, and 86, when compacted adjacent one another as depicted, creates irregular sized spaces or gaps between the adjacent compacted shot in the fill media. The irregular shape of the individual components, 76, 78, 80, 82, 84, and 86 of fill media 40 will cause turbulence when gas, or a flame front, passes around those irregular surfaces. In addition, the above-described spaces or gaps formed between the adjacent irregular shaped components 76-86, likewise creates a turbulent flow of the gas passing therethrough. This turbulence created as a result of the gas following the torturous path through the irregular shape fill media functions to extinguish the flame.

Moreover, in addition to increasing turbulence, the fact that components 76-86 of fill media 40 are of an irregular shape means that a greater surface area is provided over which the flame must pass. This greater surface area contributes to increased heat transfer between the flame and the fill media thereby extinguishing the flame. The irregular shaped fill media 40 contained within canister 32 in providing the greater component surface area as well as a torturous path for the flame to travel through the fill media results in a optimum pressure drop per unit volume of fill media which contributes to maximum flame arrestment per unit volume of fill media. However, as discussed above, the length of canister 32 can be varied such that a sufficient volume of fill media is provided so that the aggregate pressure drop of the gas passing through fill media 40 of canister 32 can be maintained at a desired (low) value.

In order to maintain the minimal space or gap between adjacent components, such as 76-86 of FIG. 6, it is desired to compact fill media 40 within canister 32. This accomplished in the preferred embodiment by inserting a media displacing bolt 90 through domed face 50 into fill media 40 contained within canister 32. The end 92 of media displacing bolt 90 is tapered so as to wedge against the fill media 40 in order compress fill media 40 within canister 32.

In the preferred embodiment, media displacing bolt 90 is threaded through domed surface 50 of outer cylinder 34 in order to be tightened to increase compression of fill media 40 or removed so as to replace or clean fill media 40 (described below).

A threaded collar 94 is welded into domed face 50 of outer cylinder 34 to receive media displacement bolt 90. Collar 94 is tapped with threads which mate the threads of media displacing bolt 90 so that media displacing bolt 90 can be threaded through collar 94 (and therefore domed face 50 of outer cylinder 34) so that taper 92 wedges against fill media 40 thereby compacting fill media 40.

In an alternate, sealed embodiment, displacing bolt 90 could be welded into domed face 50 of outer cylinder 34. In this sealed embodiment, the fill media could not be removed through collar 94 in domed face 50 in order to be cleaned or replaced.

Figure 8:
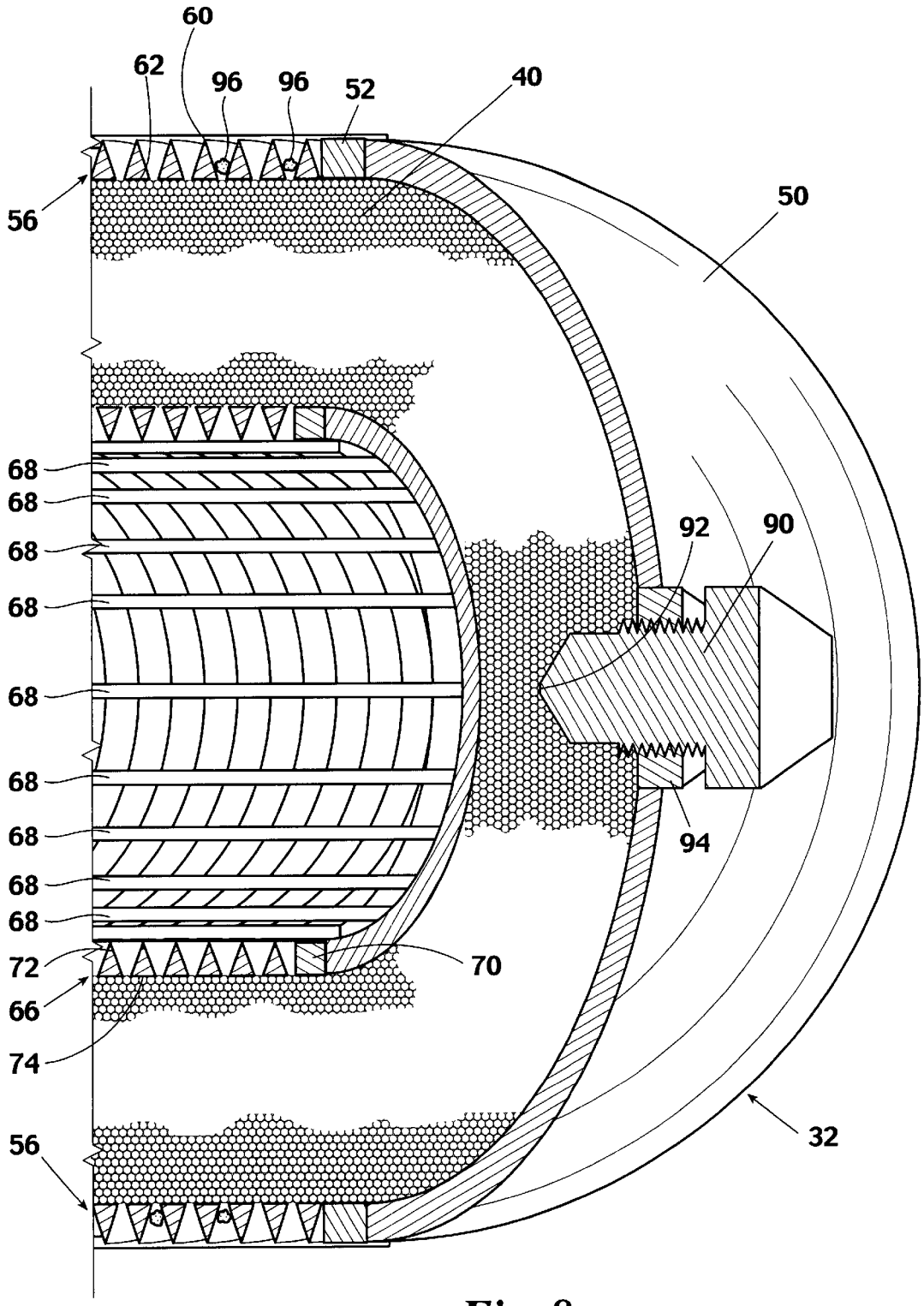
FIG. 8 is a detail cut-away view depicting the assembly of the spiral windings of the wedge wire screens of the inner and outer cylinders with fill media inserted between the inner and outer cylinders.

With reference to FIG. 8, debris (contaminants) carried in the gas stream, collectively 96, is trapped between adjacent windings of tapered surface 60 of spiral wound wedge wire screen 56 of outer cylinder 34. Trapped debris 96 can be easily dislodged upon application of a reverse flow within the canister by injecting a high pressure cleaning solution into fill media 40 through domed face 50 of outer cylinder 34. In an alternate embodiment, additional fittings could be placed on domed face 50 to allow connection of a source of high pressure cleaning solution to be injected into fill media 40 through domed face 50 of outer cylinder 34. Likewise, any debris which may become trapped between tapered surface 72 of adjacent windings of spiral wound wedge wire screen 66 of inner cylinder 36 may be dislodged by the flow from the injection of the high pressure cleaning solution as described above.

Fill media 40 can be replaced or recharged by removing canister 32 from the outer housing of flame arrestor 10 by removing displacing bolt 90 from domed face 50 of outer cylinder 34. Fill media 40 can then be removed from canister 32 through collar 94 and either replaced with fresh fill media or the existing fill media 40 could cleaned and reinstalled within canister 32, with displacing bolt 90 threaded back into collar 94 such that taper 92 compresses fill media 40 within canister 32 as described above.

In addition, in the event of a change of the type of gas in the pipeline, fill media 40 could be removed and replaced with a fill media of a component diameter which is suitable for the new gas application.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

In the claims:

1. A detonation flame arrestor canister supported within an external housing; comprising:

a canister flange supported within the external housing;

an inner cylinder including a first end, a second end, an outer circumference, and an outer diameter;

said first end of said inner cylinder is supported from said canister flange;

said second end of said inner cylinder is closed;

an outer cylinder including a first end, a second end, an outer circumference, and an inner diameter;

said inner diameter of said outer cylinder being larger than said outer diameter of said inner cylinder such that a space is formed between said inner cylinder and said outer cylinder when said outer cylinder is placed over said inner cylinder;

said first end of said outer cylinder is supported from said canister flange;

said second end of said outer cylinder is closed;

at least a portion of said outer circumference of said outer cylinder being defined by a helically wound screen;

at least a portion of said outer circumference of said inner cylinder being perforated to allow a gas to pass through said perforated portion;

a fill media contained in said space formed between said inner cylinder and said outer cylinder.

2. The canister of claim 1 wherein said helically wound screen of said outer cylinder is a helically wound wedge wire screen.

3. The canister of claim 2 wherein said perforated portion of said inner cylinder is defined by a helically wound screen.

4. The canister of claim 2 wherein said helically wound screen of said inner cylinder is a helically wound wedge wire screen.

5. The canister of claim 2 used in association with gas having a known MESG wherein said helically wound wedge wire screen of said outer cylinder is comprised of coiled adjacent windings of wedge wire such that the gap between said coiled adjacent windings of wedge wire is sized so as to increase velocity and decrease pressure of the shock wave.

6. The canister of claim 2 wherein said first end of said outer member is closed with a domed-shaped cap.

7. The canister of claim 3 wherein said domed-shaped cap contains a bolt threaded therethrough.

8. The canister of claim 1 wherein said first end of said outer cylinder is closed with a domed-shaped cap.

9. A detonation flame arrestor canister supported within an external housing; comprising an inner member including a first end, a second end, and a surface;

said second end of said inner member is closed;

an outer member including a first end, a second end, and an surface;

said outer member being larger than said inner member such that said inner member is capable of insertion into said outer member wherein a space is formed between said inner member and said outer member when said inner member is inserted and supported in said outer member;

the space between said first end of said outer member and said first end of said inner member is closed;

said second end of said outer member is closed;

at least a portion of said surface of said outer member is defined by a spiral wound screen;

at least a portion of said surface of said inner member is perforated to allow a gas to pass through said perforated portion;

a fill media contained in said space formed between said inner member and said outer member such that said fill media is retained in said space by said spiral wound screen defining said surface of said outer member and said perforated portion defining said surface of said inner member.

10. The canister of claim 9 wherein said spiral wound screen of said outer member is wound helically to form said surface of said outer member.

11. The canister of claim 10 wherein said spiral wound screen of said outer member is a spiral wound wedge wire screen.

12. The canister of claim 9 wherein said perforated portion of said inner member is defined by a spiral wound screen.

13. The canister of claim 12 wherein said spiral wound screen of said inner member is a spiral wound wedge wire screen.

14. The canister of claim 13 wherein said spiral wound screen of said inner member is wound helically to form said surface of said inner member.

15. The canister of claim 10 used in association with gas having a known MESG wherein said spiral wound wedge wire screen of said outer member is comprised of coiled adjacent windings of wedge wire such that the gap between said coiled adjacent windings of wedge wire is sized so as to increase velocity and decrease pressure of the shock wave.

16. The canister of claim 9 wherein said first end of said outer member is closed with a domed-shaped cap.

17. The canister of claim 16 wherein said domed-shaped cap contains a bolt threaded therethrough.

18. The canister of claim 9 wherein said first end of said inner member is closed with a domed-shaped cap.

19. A detonation flame arrestor canister supported within an external housing; comprising:

an inner member including a first end, a second end, and a surface;

said second end of said inner member is closed by a domed-shaped cap;

an outer member including a first end, a second end, and a surface;

said outer member being larger than said inner member such that said inner member is capable of insertion into said outer member wherein a space is formed between said inner member and said outer member when said inner member is inserted and supported in said outer member;

the space between said first end of said outer member and said first end of said inner member is closed;

said second end of said outer member is closed by a domed-shaped cap;

at least a portion of said surface of said outer member is defined by a wedge wire screen;

at least a portion of said surface of said inner member is defined by a wedge wire screen;

a fill media contained in said space formed between said inner member and said outer member such that said fill media is retained in said space by and between said screen defining said surface of said outer member and said screen defining said surface of said inner member.

20. The canister of claim 19 used in association with gas having a known MESG wherein said wedge wire screen of said outer member is comprised of helically coiled adjacent windings of wedge wire such that the gap between said helically coiled adjacent windings of wedge wire is sized so as to increase velocity and decrease pressure of the shock wave.

* * * * *